United States Patent [19]

Gunning et al.

[11] 3,979,632

[45] Sept. 7, 1976

[54] CATHODE RAY TUBE HAVING SURFACE CHARGE INHIBITING MEANS THEREIN

[75] Inventors: Everett A. Gunning, Lock Haven, Pa.; Charles H. Rehkopf, Seneca Falls, N.Y.

[73] Assignee: GTE Sylvania Incorporated, Stamford, Conn.

[22] Filed: July 17, 1974

[21] Appl. No.: 489,137

[52] U.S. Cl. ..... 313/479; 313/450

[51] Int. Cl.[2] ..... H01J 29/06; H01J 31/00

[58] Field of Search ..... 313/450, 479

[56] References Cited

UNITED STATES PATENTS

| | | | |
|---|---|---|---|
| 3,355,617 | 11/1967 | Schwartz | 313/107 X |
| 3,536,527 | 10/1970 | Javorik et al. | 313/479 X |
| 3,758,802 | 9/1973 | Kubo et al. | 313/479 |

*Primary Examiner*—Robert Segal
*Attorney, Agent, or Firm*—Norman O'Malley; Frederick H. Rinn; Robert T. Orner

[57] ABSTRACT

Means for deterring the build-up of a deleterious negative charge on the neck portion of a cathode ray tube is provided for utilization in especially those tubes wherein the electron gun structure is particularly close to the glass surface of the encompassing neck. The charge inhibiting means is formed of a circumferential band of insulative oxide material having a roughened topography to provide a discontinuous surface condition to break-up the deposition of metallic sublimation resultant from high temperature tube processing and conditioning. The band is oriented substantially in the rearward section of the neck on the portion thereof substantially encompassing the cathode region of the gun structure.

1 Claim, 3 Drawing Figures

CATHODE RAY TUBE HAVING SURFACE CHARGE INHIBITING MEANS THEREIN

BACKGROUND OF THE INVENTION

This invention relates to means for minimizing arcing within a cathode ray tube and more particularly to improved means for utilization in a cathode ray tube to inhibit the buildup of surface charge in the neck region thereof.

With the advance of cathode ray tube technology, there has been a trend toward miniaturization and compaction of electron gun structures, which in turn are encompassed within envelope neck portions of smaller diameters and shorter lengths. Consequently, spacings between the electrode components of the electron gun structure and the adjacent sidewall of the enclosing neck portion have become increasingly smaller. This condition is particularly true in color cathode ray tubes of in-line gun construction wherein the side-oriented guns in the gun assembly are particularly close to the wall of the neck.

During cathode ray tube manufacturing, especially in the tube exhaust and processing steps, the cathode is operated or conditioned at a much higher temperature than that subsequently encountered during normal operation. As a result, there is an effusion or metallic vaporization, particularly of nickel, which emanates from the cathode and thence deposits on adjacent surfaces. Since the wall of the neck is particularly close to certain of the electron guns in the gun assembly, a conductive metallic sublimation is naturally deposited thereon.

In cathode ray tube construction it is conventional practice for the funnel-disposed conductive coating to extend into the forward region of the neck portion, such coating usually being of the high positive electrical potential of the final electrode of the gun assembly. The adjacency of this high potential conductive coating at the forward end of the neck portion, in conjunction with the neighboring cathode sublimation deposition at the rear of the neck portion, creates an arc-fostering condition during tube operation. This neck-oriented electrical conductive sublimation deposition is conducive for the relatively slow build-up of a deleterious negative charge effect on the interior surface of the neck, which upon reaching a breakdown level discharges as an areal release of current toward the forwardly disposed positively charged conductive coating with the effect of a soft arc. This type of arcing is a phenomenon somewhat analogous to the charge and discharge of a capacitor whereof the discharge is normally non-destructive. Such arcing is normally repetitive with the gradual buildup time being in the order of several seconds to a plurality of minutes. The resultant discharge is audibly and visibly annoying to the observer since it affects both the audio and video portions of the circuitry associated with the operating tube. The audio effect is usually apparent as a "click", whereas the video influence is normally evidenced in two ways, first in the form of a momentary raster disturbance such as an areal constriction or distracting flicker, and, secondly, as an abrupt change of edge color-definition and sharpness of the imagery in the screen display, which is commonly referred to as static mis-convergence. For example, in a shadowmask type of color cathode ray tube employing an in-line gun assembly, the electron beams on either side of the gun structure are indirectly influenced by the surface charge buildup on the rearward portion of the neck. As the negative charge increases, there is also evidence of a counter positive charge build-up emanating from the extension of the funnel coating onto the adjacent glass at the forward end of the neck. In some instances, this charge effect is further promoted by minute depositions of surface contamination emanated from the adjacent gun electrodes during tube conditioning. As the positive charge migrates beyond the coated area per se, further into the neck toward the negatively charged area, it tends to effect an under-converging influence on the beams at the forward end of the gun assembly, especially through the gap between the G3–G4 electrodes. The presence of this positive charge influence gradually causes the outer beams to move slightly outward from their normal paths. Such change in beam positioning is noticeable as a gradual deterioration in the color imagery of the screen display wherein the edge definitions of display elements become gradually multicolored and lose sharpness due to misplacement of beam impingement on the screen. This condition, referenced as static convergence drift, increases until arc discharge, whereupon the beams revert to their normal positioning causing an abrupt and noticeable change in edge-sharpness. Consequently, the edge-definition again gradually deteriorates as the charge build-up relationship repeats.

OBJECTS AND SUMMARY OF THE INVENTION

It is an object of this invention to reduce and obviate the aforementioned disadvantages that have been evidenced in the prior art. Another object of the invention is to provide an improved neck surface charge inhibiting means that is of expeditious fabrication. A further object is to provide a means for minimizing static convergence drift within the tube.

These and other objects and advantages are achieved in one aspect of the invention wherein an improvement in a cathode ray tube is in the form of a neck-surface-charge inhibiting means composed of a definitive band of roughened insulative oxide material that is disposed on a discretely isolated area of the interior surface of the neck portion of the tube. Specific location of the insulative band is associated with the cathode region of the electron generating assembly, and is so oriented to intercept metallic vaporization that may be effused from the cathode, in the direction of the wall of the neck portion, during tube processing and conditioning. The sublimation, resultant from cathodic effusion, deposits on the roughened topography of the oxide band and effects a discontinuous deposition, which provides a deterrent to the build-up of a deleterious negative surface charge, emanating from substantially the cathode region, on the interior of the neck portion.

DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

While the invention is applicable to utilization in any type of cathode ray tube wherein the electrode components of the gun assembly are closely adjacent to the sidewall of the neck portion, for purposes of illustration, a color cathode ray tube employing an apertured shadowmask and an in-line plural gun electron generating assembly will be described in this specification.

Figure 1:
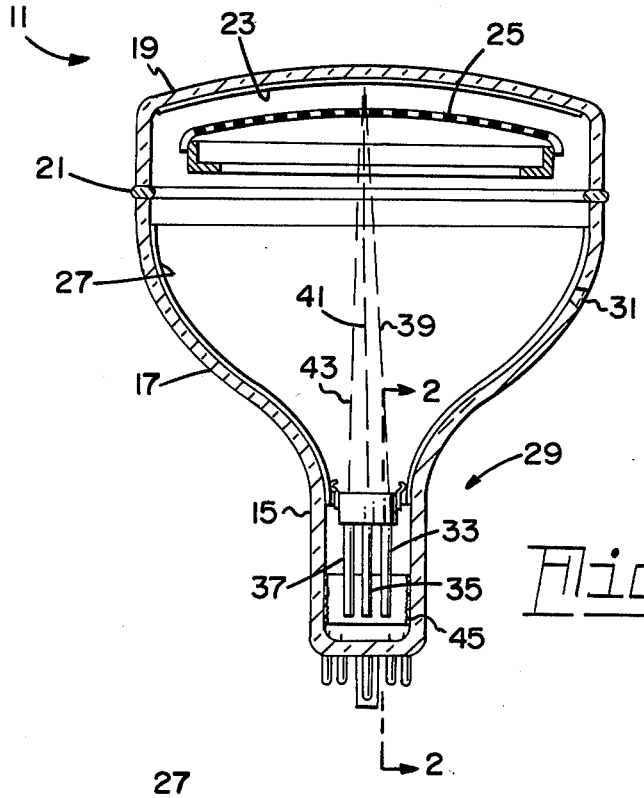
FIG. 1 is a cross-sectional view of a cathode ray tube wherein the invention is utilized.

With particular reference to FIG. 1, a plural in-line beam color cathode ray tube construction 11 is shown as having an envelope comprised of neck 15, funnel 17, and face panel 19 portions; the panel and funnel portions being hermetically integrated during tube fabrication along the congruent sealing region 21. A patterned cathodoluminescent screen 23 of color-emitting phosphor areas is disposed on the interior surface of the viewing panel 19 as an array of definitive stripes or dots, in keeping with the state of the art. A discretely apertured structure 25, in this instance, a shadowmask, is spatially related to the patterned screen, being predeterminately positioned within the face panel by conventional means, not shown.

The interior of the funnel portion has a conductive coating 27, such as Aquadag, disposed thereon in a manner extending substantially from the forward region adjacent the panel-funnel seal 21 to the neck portion 15, whereinto it extends a partial distance making contact with the forward end of the electron gun assembly 29 oriented therein. This envelopic coating 27, which is of the positive potential of the terminal electrode of the gun assembly, is electrically connected to the screen of the tube, by means not shown. The electrical potential for this coating is usually supplied thereto by a connective button 31 traversing the wall of the funnel portion 17.

The exemplary in-line electron gun assembly 29 is partially detailed to delineate three related electron guns, 33, 35 and 37 respectively, which are aligned in a common plane, wherefrom the respective emitted electron beams 39, 41 and 43 are directed to converge at the shadowmask 25 and thence impinge the patterned screen therebeyond.

The invention is an improvement in cathode ray tube construction in the form of a neck-surface-charge inhibiting means, structured as a definitive circumferential ring or band 45 of substantially roughened insulative material. Such is disposed as an isolated area on the interior surface of the neck portion 15, at a location substantially to the rear thereof in the region substantially encompassing the cathode related portion of the electron generating assembly.

Figure 2:
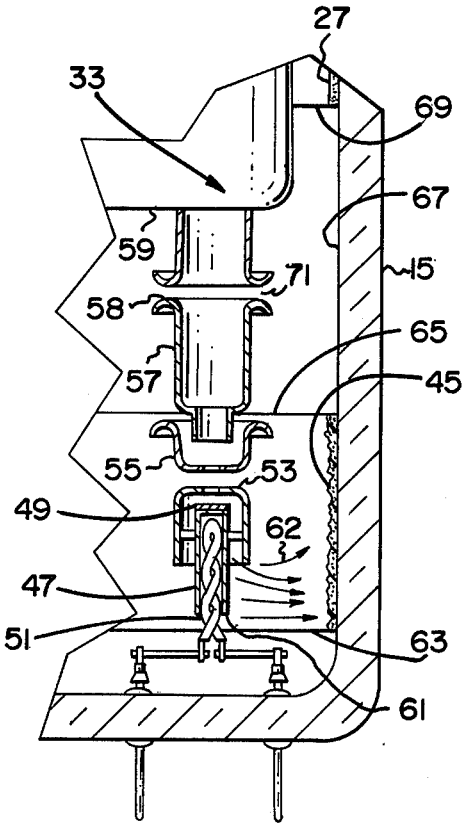
FIGS. 2 and 3 are enlarged partial sectional views of FIG. 1 taken along the line 2—2 thereof.

For greater detail, attention is directed to FIG. 2 wherein one of the electron guns 33 of the electron generating assembly 29 is delineated as being particularly close to the adjacent sidewall of the encompassing neck portion 15. As shown, the electron gun 33 includes a basic electron generating component in the form of a nickel alloy thermionic cathode 47 having electron emissive material 49 oriented on the closed end thereof. A conventional heating element 51 is disposed within the cathode sleeve, and the assembly positioned within the control (G1) electrode cup 53. Other components sequentially related in the gun structure include acceleration (G2) 55, focusing (G3) 57, and convergence (G4) 59 electrode members.

The insulative band 45, disposed on the sidewall of the neck portion in a manner to substantially encompass the cathode region of the electron gun structure, is comprised of at least one material selected from the group consisting essentially of chromic oxide, ferric oxide, and a mixture of chromic-ferric oxides. This definitive band of coating material is carefully applied to a discrete area in the rear half of the neck portion 15 of the funnel and neck assembly before the screened panel is bonded to the open forward end of the funnel, along the seal line 21, and before the electron gun assembly 29 is inserted into the neck portion and sealed thereto.

The insulative coating material is formulated as a suspension, wherein, for example, about 44 weight percent of the selected oxide material is mixed with about 6 weight percent of potassium silicate and about 6 weight percent of sodium silicate, with the remainder or about 44 weight percent being of water. The silicates are included to provide good adherence and durability to the finished coating to prevent loosening or flaking when the electron gun assembly is inserted. The coating material is applied through the open end of the neck portion, and subsequently cured during the panel-funnel sealing step, wherein a temperature in the neighborhood of 450° C is utilized. Since the coating material has a transformation or curing temperature in the neighborhood of 350° C, a band of durable coating is achieved. The electron gun structure is thence inserted into the open end of the neck portion and hermetically sealed thereto, whereupon the tube structure is then exhaust-processed and aged.

During aging in particular, the cathode region of the gun assembly is subjected to much higher temperatures than those encountered during normal tube operation. These high conditioning temperatures are of levels which effect a degree of vaporization of nickel from the cathode. Some of this vaporized metallic material is diffused, as indicated by arrows 62, in the direction of the wall of the adjacent neck portion whereupon the band of insulative oxide is priorly disposed. The resultant sublimation, which settles on the roughened surface of the band, effects a discontinuous deposition, and prevents the sublimation from creating a large conductive area or path. This, in turn, is a deterrent to the build-up of a deleterious negative surface charge on that region of the neck. It has been found, that it is beneficial to have the lower boundary 63 of the insulative band in a plane that is beneath the open end 61 of the cathode 47. To adequately control the sublimation deposit, the upper boundary 65 of the band should be in a plane substantially in the region of the focusing electrode (G3) 57, but rearward of the forward end 58 thereof. It is desirable to have an insulative spacing 67 or area of glass wall between the upper boundary 65 of the insulative band and the lower boundary 69 of the extension of the funnel coating 27. While a full explanation of the benefits of the substantially bare glass area 69 is not fully understood, it has been found that such a defined bare glass area therebetween is more beneficial than extending the roughened coating 45 up to the vicinity of the funnel coating extension 27.

The use of the roughened oxide band 45 deters the build-up of a deleterious negative surface charge on the rear portion of the tube neck. The absence of an appreciable negative charge in that region minimizes the prevalence of arcing and discourages the formation of an extension of the positive high potential field into the central neck region that is of a magnitude sufficient to noticeably affect the beams and produce static convergence drift. The G3–G4 gap 71 in the gun structure is the region through which a high potential positive field can adversely affect beam convergence.

Figure 3:
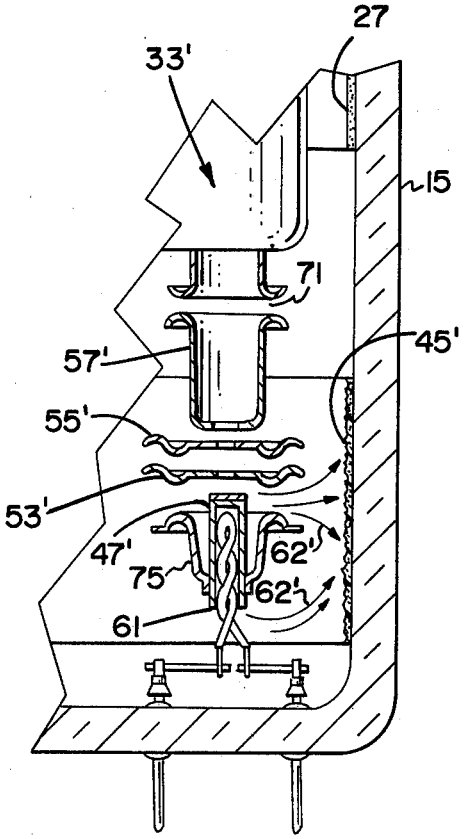

With reference to FIG. 3, there is shown the employment of another roughened oxide band 45' in conjunction with a different embodiment of a more compact in-line gun structure 33'. A planar control grid (G1) 53' is shown in association with an open type of cathode support member 75. With this type of gun structure, processing vaporization from the top of the cathode structure diffuses outward under the planar control electrode 53'. The oxide coating 45' is advantageously positioned and is of an area adequate to form a roughened deposition surface for the resultant metallic sublimation, from vaporization 62', that is sufficient to inhibit surface charging.

Thus, there has been provided a neck-surface-charge inhibiting means for utilization in a cathode ray tube that effects a discontinuous surface condition thereby providing a beneficial deterrent to the build-up of a deleterious negative surface charge on the neck portion of the tube. The charge inhibiting means of the invention is one that can be expeditiously achieved during tube manufacturing. It is particularly advantageous in tube constructions wherein the electron gun structure is positioned in close spacing with the sidewall of the encompassing neck.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube having an envelope with a cathodoluminescent screen formed on the viewing panel portion, a conductive coating disposed on the funnel and upper neck portions, and a related multi-electrode electron generating assembly including at least one cathode, and associated control (G1), acceleration (G2), and focusing (G3) electrodes sequentially positioned in the neck portion in a manner to beam electrons to said screen, said improvement being neck surface charge inhibiting means comprising:

a definitive circumferential band of substantially roughened insulative oxide material disposed as an isolated area on the interior surface of said neck portion, said band being comprised of at least one material selected from the group consisting essentially of chromic oxide, ferric oxide, and a mixture of chromic-ferric oxides; the location of said band being substantially to the rear of said neck portion associated with substantially the cathode region of said electron generating assembly and oriented in a position to intercept metallic vaporization effused substantially from the cathode in the direction of the wall of said neck portion during tube processing and conditioning, the lower boundary of said band being in a plane beneath the open end of said cathode, and the upper boundary in a plane substantially in the region of said focusing electrode (G3) but rearward of the forward end thereof, said roughened insulative band effecting a discontinuous surface condition thereby providing a deterrent to the build-up of a deleterious negative surface charge on said neck portion emanating from substantially said cathode region.

* * * * *